US008291655B2

(12) United States Patent
McGlothlin

(10) Patent No.: US 8,291,655 B2
(45) Date of Patent: Oct. 23, 2012

(54) ROOF WITH RIDGE VENT BRACE

(76) Inventor: Sherman Leon McGlothlin, Manassas, VA (US)

( * ) Notice: Subject to any disclaimer, the term of this patent is extended or adjusted under 35 U.S.C. 154(b) by 0 days.

(21) Appl. No.: 13/030,206

(22) Filed: Feb. 18, 2011

(65) Prior Publication Data

US 2011/0209423 A1 Sep. 1, 2011

Related U.S. Application Data

(60) Provisional application No. 61/308,457, filed on Feb. 26, 2010.

(51) Int. Cl.
*E04B 7/02* (2006.01)

(52) U.S. Cl. ..... 52/198; 52/745.06

(58) Field of Classification Search ..... 52/198, 52/199, 90.1, 302.3, 745.06; 454/365
See application file for complete search history.

(56) References Cited

U.S. PATENT DOCUMENTS

| | | | | |
|---|---|---|---|---|
| 3,135,070 | A * | 6/1964 | Waring et al. | 52/94 |
| 4,616,560 | A * | 10/1986 | Esposito | 454/341 |
| 4,624,087 | A * | 11/1986 | Schneller | 52/254 |
| 5,245,803 | A | 9/1993 | Haag | |
| 5,277,002 | A | 1/1994 | Haag | |
| 5,427,571 | A | 6/1995 | Sells | |
| 5,713,158 | A * | 2/1998 | Gibbs | 52/57 |
| 6,077,159 | A | 6/2000 | Clayton | |
| 6,237,293 | B1 * | 5/2001 | Gembala | 52/302.6 |
| 6,421,971 | B1 * | 7/2002 | Gembala | 52/302.6 |
| 6,537,147 | B2 | 3/2003 | Smith | |
| 6,945,005 | B2 | 9/2005 | Nunley | |
| 6,993,882 | B2 | 2/2006 | Crawford et al. | |
| 7,485,034 | B2 | 2/2009 | Sells | |
| 2002/0072324 | A1 | 6/2002 | Strait | |
| 2003/0230042 | A1 * | 12/2003 | Rhodebeck et al. | 52/481.1 |
| 2005/0202779 | A1 | 9/2005 | Smith | |

FOREIGN PATENT DOCUMENTS

JP 03036354 A * 2/1991

* cited by examiner

*Primary Examiner* — Christine T Cajilig
(74) *Attorney, Agent, or Firm* — Diederiks & Whitelaw, PLC

(57) ABSTRACT

A brace for securing roof decking adjacent a roof ridge vent takes the form of an elongated channel, preferably a metal J-shaped channel, with the brace being wrapped around the upper edge portion of the roof decking at the roof ridge. The brace stiffens and carries the weight of the roof decking between the roof trusses or rafters, allowing an unobstructed flow of ventilation air under the decking and preventing bowing of the roof decking. The brace is at least partially covered by a line of shingles and then mounting flange portions of a ridge vent extend over each of the brace, decking edge and shingles.

20 Claims, 2 Drawing Sheets

ROOF WITH RIDGE VENT BRACE

CROSS-REFERENCE TO RELATED APPLICATIONS

The present application claims the benefit of U.S. Provisional Patent Application Ser. No. 61/308,457 entitled "Roof with Ridge Vent Brace" filed Feb. 26, 2010.

BACKGROUND OF THE INVENTION

1. Field of the Invention

The present invention pertains to the building industry and, more particularly, to bracing for use in securing roof decking adjacent a roof ridge vent.

2. Discussion of the Prior Art

In the construction of various types of buildings, wood products are widely used as a base layer for a roof. That is, sheets of OSB sheathing or plywood are generally nailed or screwed to roof trusses or rafters to establish decking for the roof, typically followed by shingles being secured upon the sheets. Particularly when constructing a residential home, it is also common to form the roof with a peak and provide venting of an attic space at the peak or ridge of the roof. Typically, a gap is established along the peak, with the gap opening directly into an attic space of the residence. A ridge vent assembly, typically formed of various elongated, perforated metal members arranged in an overlapping manner, is then mounted over the gap along the entire peak. More specifically, the ridge vent assembly includes side flanges mounted along each side of the peak, with the flanges sitting atop the shingles. With this construction, heated air that collects in the attic space is permitted to escape from the residence through the ridge vent assembly, thereby providing for a more energy efficient, configuration, particularly during summer months when an owner may be trying to cool the air in the, home while the attic space contains rather hot air.

Certainly, the roof needs to be constructed in a manner which prevents the ingress of rain water. One factor that can seriously compromise these features is warping of the sheets establishing the roof decking along lines adjacent the peek. To address this potential flaw, it is known to mount blocks, such as pieces of 2×4 wood studs, between the roof trusses or rafters, thereby providing support directly beneath the uppermost edges of the decking. Unfortunately, mounting these blocks can be fairly time consuming. In addition, the blocks do not allow for an unobstructed flow of ventilation air from between the rafters to the ridge vent assembly.

Based on these and other perceived construction drawbacks associated with the typical, construction of buildings with vented peaks, it is considered desirable to provide an arrangement which eases aspects of the overall construction, substantially prevents roof decking from warping along lines adjacent a ridge roof assembly and allows unobstructed flow of ventilation air moving under the sheathing and exiting the ridge vent.

SUMMARY OF THE INVENTION

The present invention is directed to a brace for securing a roof deck adjacent a roof ridge'vent. More specifically, the brace takes the form of an elongated metal, preferably J-shaped channel, with the brace being wrapped around the upper edge portion of the roof decking, such as OSB sheathing or plywood, at the roof ridge. The brace stiffens and carries the weight of the roof decking between the roof trusses or rafters, allowing an unobstructed flow of ventilation air under the decking and preventing bowing of the roof decking. In the winter, this unobstructed air flow exists from the soffit to the ridge vent which aids in preventing ice damming. The brace is at least partially covered by a line of shingles and then mounting flange portions of a ridge vent extend over each of the brace, decking edge and shingles.

Additional objects, features and advantages of the present invention will become more readily apparent from the following detailed description of preferred embodiments when taken in conjunction with the drawings wherein like reference numerals refer to corresponding parts in the several views.

DETAILED DESCRIPTION OF PREFERRED EMBODIMENTS

Figure 1:
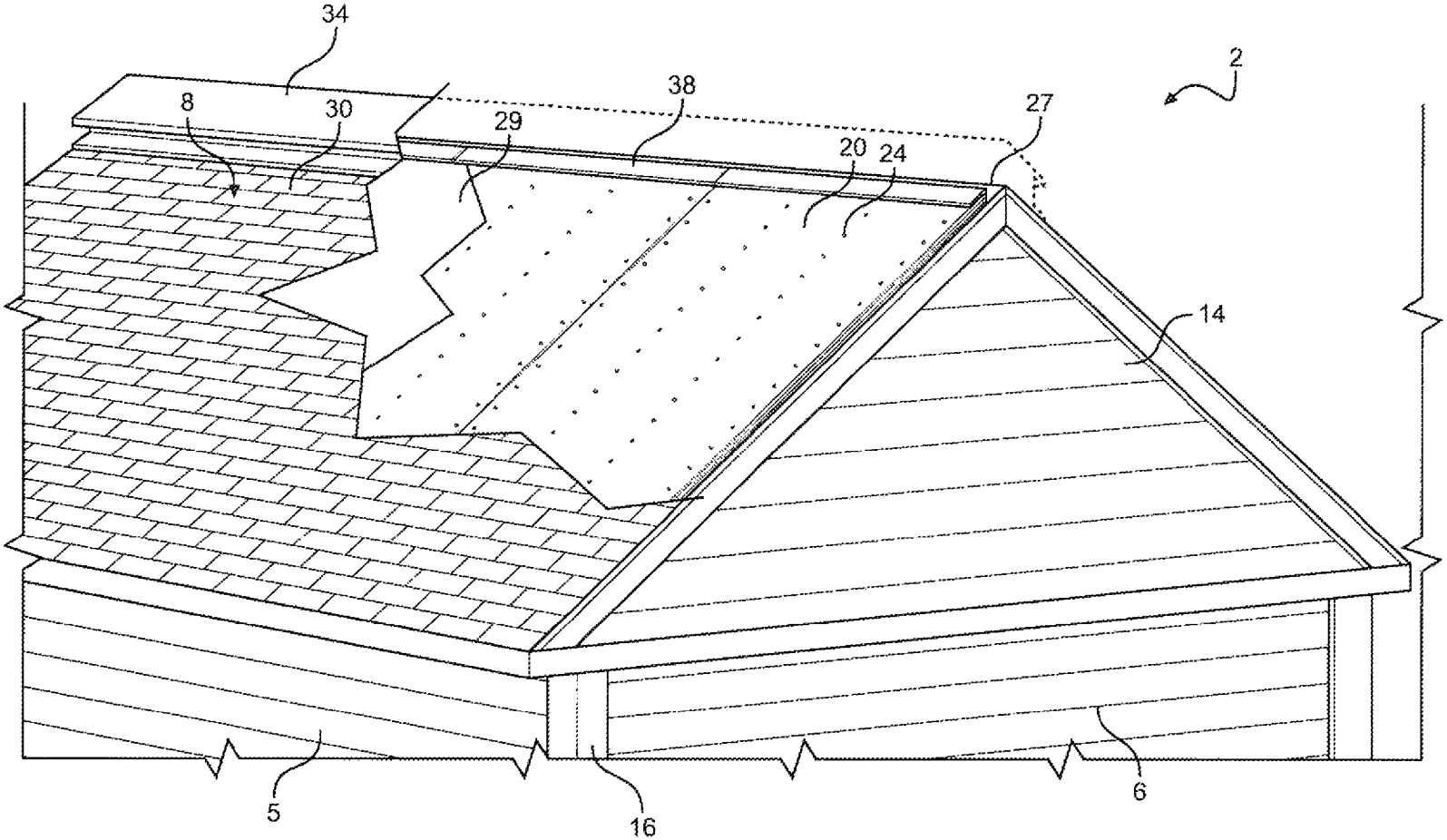
FIG. 1 is a partial perspective and exploded view of a residential building employing a ridge vent brace in accordance with the invention.

With initial reference to FIG. 1, a portion of a building constructed utilizing the ridge vent brace of the invention is generally indicated at 2. Based on the illustrated angle of building 2, which, can be a residential or commercial building, both a first upstanding side wall 5 and a second upstanding side wall 6 are shown, along with a roof 8. As depicted, roof 8 constitutes a gable-style roof, although it should be understood that the invention can also be employed in connection with other types of known roofing constructions, including hip and Gambrel roofs. As also shown in this figure, side walls 5 and 6 are provided with siding 14, such as aluminum, vinyl or wood planks, as well as associated corner trim. 16. Of course, it, should be realized that other types of known exterior finishes could be used, including brick, stone and the like.

In a similar manner, roof 8 can be constructed of various materials. As shown, roof 8 includes roof decking 20, such as OSB sheathing or plywood which are held in place by various, fasteners 24, such as nails or screws. Roof decking 20 is mounted up to a peak or ridge 27 and has mounted thereon roofing or tar paper 29, as well as shingles 30 or other known weatherguard roofing members. At the peak 27, in a manner known in the field, roof decking 20 and shingles 30 stop short of peak 27 and an elongated ridge vent 34 is provided to cover this portion of roof 8 from the ingress of rain and the like, while also permitting heated air to escape from an uppermost portion, such as an attic space (not labeled) of building 2, thereby enhancing the overall energy efficiency of the construction. At this point, it should be noted that these details of building 2 are provided for the sake of completeness and are not intended to be limiting to the invention. Instead, the invention is more specifically concerned with the inclusion and structure of a ridge vent brace 38 in the overall construction.

Figure 2:
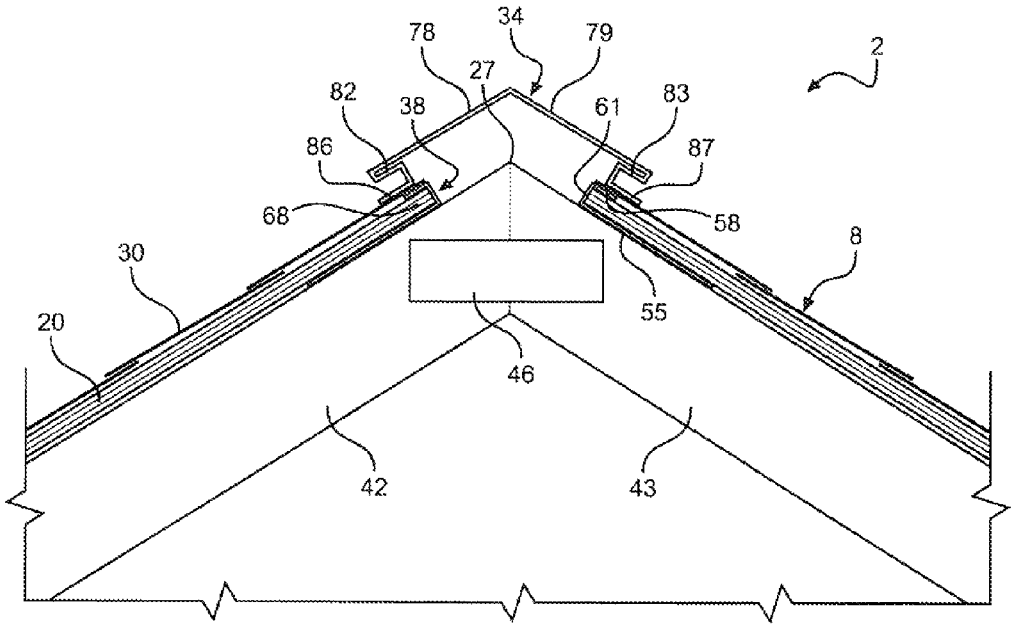
FIG. 2 is a cross-sectional side view of a roof ridge with ridge vent brace according to the invention.

As shown in FIG. 2, a cross-sectional side view of the uppermost portion of gable roof 8 depicts rafters 42 and 43, which can be separately mounted or formed as part of a pre-assembled truss structure. A connecting plate or truss gusset 46 is shown connecting rafters 42 and 43, although a ridge board-type construction is also common in the field. Most, importantly, this figure illustrates the mounting of various ridge vent braces 38 in accordance with the invention.

However, before detailing this mounting, the preferred construction of ridge vent brace 38 will now be described with reference to FIG. 3.

Figure 3:
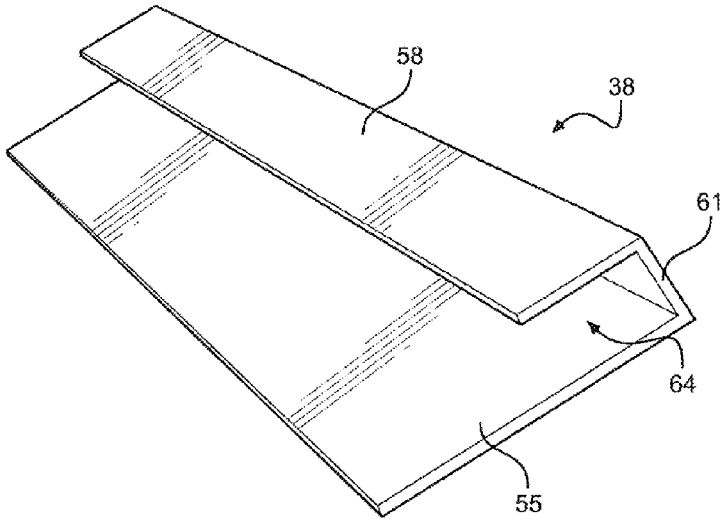
FIG. 3 is a perspective view of a preferred embodiment of the ridge vent brace of the invention.

The perspective view of FIG. 3 shows each ridge vent brace 38 including a base leg 55, an upper leg 58 and a connecting leg 61. In the most preferred embodiment, connecting leg 61 extends substantially perpendicular to and spaces base and upper legs 55 and 58, thereby establishing a channel 64 between base leg 55 and upper leg 58. Base leg 55 preferably projects from connecting leg 61 a distance substantially greater than upper leg 58 such that ridge vent brace 38 assumes a J-shape from an end view. Although ridge vent brace 38 could be made of various stiff and substantially inflexible materials, the invention preferably employs metal, such as galvanized steel or other metal of sufficient thickness, such as 18-25 gauge. In the most preferred form of the invention, ridge vent brace 38 is, provided in a length and channel dimension matching roof decking 20. Therefore, if roof decking 20 constitutes ½" thick, 4'×8' plywood sheets, each ridge vent brace 38 is 8 feet long and base leg 55 is spaced from upper leg 58 by a distance just slightly greater than ½", such as 9/32" or 5/16". In accordance with the invention, the width of base and upper legs 55 and 58 can vary, with base leg 55 preferably being more than twice the dimension of upper leg 55 to establish the J-shape. For instance, base leg 55 can be made approximately 2 inches wide, while upper leg 58 is approximately ¾" wide, as measured projecting from connecting leg 61. If desired, greater dimensions can be employed, such as base leg 55 being approximately 6 inches wide and upper leg being approximately 2" wide.

Given this construction, as shown best in. FIG. 2, each ridge vent brace 38 is adapted to slip over an uppermost edge 68 of a respective sheet of roof decking 20, with each ridge vent brace 38 extend rig along, yet being spaced from, peak 27. Given the dimensioning of ridge vent brace 38 relative to roof decking 20, the uppermost edge of roof decking 20 is snugly received in channel 64, with ridge vent brace 38 being held down by the mounting of roof decking 20 to the respective rafter 42, 43. Thereafter, ridge vent 34 is mounted along peak 27 and extends over the upper leg 58 of each ridge vent brace 38. More particularly, ridge vent 34 is shown to-include interconnected, angled panels 78 and 79, each of which leads to a respective in-turned portion 82, 83 and a mounting flange 86, 87. It is mounting flanges 86 and 87 which extend beyond the respective upper legs 58 and atop portions of shingles 30, then are used to secure ridge vent 34 to roof decking 20 with mechanical fasteners (not shown).

Due to the use of the ridge vent braces of the invention, the number of which will depend on the actual length of the roof, the uppermost edge portions of the roof decking will not be able to warp or otherwise deform in a manner which could lead to leaking of the roof adjacent the ridge vent. That is, the uppermost edge portions are snugly captured in the base channels and, since the braces are stiff and substantially inflexible, the shape of the uppermost edge portions are maintained. Therefore, in accordance with the invention, it should be recognized that the ridge vent braces function to stiffen and carry the weight of the roof decking between the rafters, preventing bowing of the roof decking. In addition, the use of the ridge vent braces, avoids the need to install boards or studs between the rafters in order to directly nail down the uppermost edge of the roof decking such that employing the ridge vent bracing of the invention also ensures the unobstructed and efficient flow of ventilation air moving under the decking to the ridge vent. In the winter, this unobstructed flow of air occurs from the soffit to the ridge vent, keeping the underside of the roof sheeting at a modified temperature to aid in preventing ice damming.

Although described with reference to preferred embodiments of the invention, it should be readily understood that various changes and/or modifications can be made to the invention without departing from the spirit thereof. In general, the invention is only intended to be limited by the scope of the following claims.

I claim:

1. A building comprising:

a plurality of interconnected, upstanding side walls; and a roof including:

a plurality of spaced rafters extending above the side walls, to a roof peak;

roof decking including a plurality of roofing sheets positioned upon the plurality of spaced rafters, with upper ones of the plurality of roofing sheets including uppermost edge portions which terminate, at a position spaced from the roof peak; and a plurality of ridge vent braces, with each ridge vent brace including:

a base leg;

an upper leg; and a connecting leg joining the base leg and the upper leg while establishing a channel between the base leg and the upper leg, with the channel receiving the uppermost edge portion of a respective said roofing sheet such that the base leg is interposed between the rafters and the roof decking and the upper leg is positioned above the roof decking, wherein each of the plurality of ridge vent braces is stiff and substantially inflexible so as to prevent deformation of the uppermost edge portions of the roof decking; and at least one ridge vent member extending along the peak.

2. The building according to claim 1, wherein the, plurality of ridge vent braces are indirectly secured to the rafters through the roof decking at a position adjacent the roof peak.

3. The building according to claim 1, wherein the stiff, substantially inflexible material is metal.

4. The building according to claim 1, wherein the base leg extends from the connecting leg a distance greater than the upper leg.

5. The building according to claim 4, wherein the base leg extends at least twice as far from the connecting leg as the upper leg.

6. The building according to claim 5, wherein each ridge vent brace is substantially J-shaped in side view.

7. The building according to claim 6, wherein the connecting leg extends substantially perpendicular to each of the base and upper legs.

8. The building according to claim 1, wherein the uppermost edge portion of the respective said roofing sheet is snugly received within the channel.

9. The building according to claim 1, wherein the at least one ridge vent member both covers the roof peak and extends over the plurality of ridge vent braces.

10. The building according to claim 1, wherein the channel has a length equal to a length of the uppermost edge portion of the respective said roofing sheet.

11. A method of constructing a roof of a building including side walls and rafters extending above the side walls to a peak of the building comprising:

positioning uppermost edge portions of sheets of roof decking within channels defined between interconnected base and upper legs of ridge vent braces;

securing the sheets of roof decking to the rafters such that the uppermost edge portions and the ridge vent braces are spaced from the peak, the base legs are interposed between the rafters and the roof decking, and the upper legs are positioned above the roof decking, wherein each of the plurality of ridge vent braces is stiff and substantially inflexible so as to prevent deformation of the uppermost edge portions of the roof decking; and securing at least one ridge vent member along the peak.

12. The method of claim 11, wherein the ridge vent braces are only indirectly secured to the rafters through the roof decking.

13. The method of claim 11, wherein the uppermost edge portions of the roof decking are snugly received within the channels of the ridge vent braces.

14. The method of claim 11, further comprising: mounting the at least one ridge vent member over both the peak and the ridge vent braces.

15. The method of claim 11, further comprising: employing ridge vent braces each having a channel length equal to a length of a respective sheet of the roof decking.

16. The method of claim 11, further comprising: positioning the ridge vent braces relative to the peak such that the base legs extend further from the peak than the upper legs.

17. The method of claim 11, further comprising: attaching shingles on the roof, with a line of the shingles at least partially covering the ridge vent braces.

18. The method of claim 17, further comprising: extending mounting flange portions of the at least one ridge vent over each of the ridge vent braces, the uppermost edge portions of the roof decking and at least a section of the line of shingles.

19. The method of claim 11, wherein securing the sheets of roof decking constitutes nailing a plurality of wood roofing sheets.

20. The building according to claim 1, wherein each of the plurality of roofing sheets is formed of wood.

* * * * *